US009567958B2

(12) United States Patent
Fischer et al.

(10) Patent No.: US 9,567,958 B2
(45) Date of Patent: Feb. 14, 2017

(54) FUEL INJECTION SYSTEM HAVING A FUEL-CARRYING COMPONENT, A FUEL INJECTOR AND A CONNECTING ELEMENT

(71) Applicant: Robert Bosch GmbH, Stuttgart (DE)

(72) Inventors: Michael Fischer, Niefern-Oeschelbronn (DE); Michael Knorpp, Weissach (DE); Martin Riemer, Untergruppenbach (DE); Hans-Georg Horst, Leonberg (DE); Andreas Glaser, Stuttgart (DE); Philipp Rogler, Stuttgart (DE); Jan Herrmann, Stuttgart (DE); Andreas Rehwald, Bietigheim-Bissingen (DE); Michael Mayer, Wannweil (DE); Volker Scheef, Ludwigsburg (DE); Wilhelm Reinhardt, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 334 days.

(21) Appl. No.: 14/159,819

(22) Filed: Jan. 21, 2014

(65) Prior Publication Data

US 2014/0311452 A1 Oct. 23, 2014

(30) Foreign Application Priority Data

Jan. 22, 2013 (DE) ..... 10 2013 200 935

(51) Int. Cl.
*F02M 55/02* (2006.01)
*F02M 55/00* (2006.01)
*F02M 61/14* (2006.01)

(52) U.S. Cl.
CPC ..... *F02M 55/005* (2013.01); *F02M 61/14* (2013.01); *F02M 2200/857* (2013.01)

(58) Field of Classification Search
CPC ..... F02M 2200/85; F02M 2200/856; F02M 2200/858
USPC ..... 123/468–471, 490
See application file for complete search history.

(56) References Cited

U.S. PATENT DOCUMENTS 5,681,291 A * 10/1997 Galli ..... A61M 5/2033 604/156
2002/0162538 A1* 11/2002 Krause ..... F02M 61/14 123/470
2004/0016297 A1* 1/2004 Paul ..... G01G 3/13 73/580

(Continued)

FOREIGN PATENT DOCUMENTS

DE 102005020380 11/2006

*Primary Examiner* — John Kwon
(74) *Attorney, Agent, or Firm* — Norton Rose Fulbright US LLP; Gerard Messina

(57) ABSTRACT

A connecting element for fuel injection systems is used for connecting a fuel injector to a fuel-carrying component, in particular a fuel distributor rail. A base body having a receiving space is provided for this purpose. The base body has an opening, via which a fuel fitting of the fuel injector is insertable into the receiving space of the base body. Furthermore, a first annular element is provided in the receiving space, which in the installed state on the one hand interacts with the fuel fitting inserted into the receiving space and on the other hand interacts with the base body. Furthermore, a second annular element is provided in the receiving space of the base body, the first annular element and the second annular element abutting against an outside of the fuel fitting in the installed state.

12 Claims, 2 Drawing Sheets

(56) References Cited

U.S. PATENT DOCUMENTS

| | | | | |
|---|---|---|---|---|
| 2006/0266846 | A1* | 11/2006 | Ricco | F02M 47/027 239/88 |
| 2009/0247960 | A1* | 10/2009 | Kohlbrenner | A61M 5/20 604/232 |
| 2009/0266340 | A1* | 10/2009 | Eisenmenger | F02M 47/027 123/494 |
| 2012/0301581 | A1* | 11/2012 | Abegglen | B65D 85/8043 426/112 |
| 2014/0284405 | A1* | 9/2014 | Fischer | F02M 61/14 239/584 |
| 2015/0345445 | A1* | 12/2015 | Reinhardt | F02M 61/14 239/584 |

* cited by examiner

FUEL INJECTION SYSTEM HAVING A FUEL-CARRYING COMPONENT, A FUEL INJECTOR AND A CONNECTING ELEMENT

FIELD OF THE INVENTION

The present invention relates to a connecting element for fuel injection systems for connecting a fuel injector to a fuel-carrying component, and it relates to a fuel injection system having such a connecting element. The present invention specifically relates to the field of fuel injection systems for mixture-compressing internal combustion engines having externally supplied ignition.

BACKGROUND INFORMATION

German Published Patent Appln. No. 10 2005 020 380 describes a fuel injection device, which is characterized by a noise-decoupling construction. The known fuel injection device includes a fuel injector, a receiving bore for the fuel injector in a cylinder head and a fuel distributor line having a connection fitting, into which the fuel injector is inserted in a partially overlapping manner. In one possible development, a slotted snap ring is provided, which engages into a tapered section of an inflow fitting of the fuel injector. For this purpose a groove is furthermore provided in the connection fitting, in which the snap ring is engaged securely and firmly. For engaging below the fuel injector, the snap ring has a conical or vaulted spherical contact surface. A holding-down clamp is furthermore clamped between an end face of the connection fitting and a shoulder on the fuel injector.

The development of the fuel injection device known from German Published Patent Appln. No. 10 2005 020 380 has the disadvantage that vibrations may be transmitted from the fuel injector to the connection fitting via the snap ring. Furthermore, a sufficiently high retaining force must be applied via the holding-down clamp, which on the one hand holds down the fuel injector and on the other hand also applies a sufficient force on the fuel injector against the snap ring.

Especially in the case of electromagnetic high-pressure fuel injectors, which may be used in Otto engines having direct injection, an obtrusive and disturbing contribution to the overall noise of the engine may occur, which may be described as valve ticking. Such valve ticking arises from the rapid opening and closing of the fuel injector, in which the valve needle is displaced in a highly dynamic way to the respective end stops. The impact of the valve needle on the end stops leads to brief but very high contact forces which are transferred via a housing of the fuel injector to the cylinder head and to a fuel distributor rail in the form of structure-borne noise and vibrations. This leads to a strong noise development at the cylinder head and at the fuel distributor rail.

SUMMARY

The connecting element according to the present invention and the fuel injection system according to the present invention have the advantage that an improved connection of the fuel injector to the fuel-carrying component is made possible, a noise reduction and a more force-balanced connection being achieved in the process. Specifically, a soft connection of the fuel injector to the fuel-carrying component and/or a pressure-balanced or force-balanced connection of the fuel injector to the fuel-carrying component may be achieved.

The connecting element and the fuel injection system are especially suitable for direct fuel injection. The fuel-carrying component is preferably developed in this instance as a fuel distributor, especially as a fuel distributor rail. On the one hand, such a fuel distributor may be used for distributing the fuel to a plurality of fuel injectors, especially high-pressure fuel injectors. On the other hand, the fuel distributor may be used as a common fuel store for the fuel injectors. The fuel injectors are then preferably connected to the fuel distributor via corresponding connecting elements. In operation, the fuel injectors then inject the fuel required for the combustion process into the respective combustion chamber under high pressure. For this purpose, the fuel is compressed by a high-pressure pump and conveyed in controlled quantities into the fuel distributor via a high-pressure line.

The fuel-carrying component and the fuel injector, in particular the fuel fitting, are not component parts of the connecting element according to the present invention. In particular, the connecting element according to the present invention may also be manufactured and marketed separately from the fuel-carrying component as well as from a fuel injector.

Using the connecting element, it is advantageously possible to implement an effective decoupling in a compact construction and thus at a low space requirement. It is furthermore possible to save a separate holding-down clamp, which utilizes a spring force for example, or to design it with a reduced spring force.

The first annular element is advantageously developed as an O-shaped sealing ring. Accordingly, the second annular element is also advantageously developed as an O-shaped sealing ring. A soft coupling of the fuel injector to the fuel-carrying component is possible via the first annular element and the second annular element. In particular, it is possible to set a desired target stiffness. In this context, a target stiffness may be advantageously achieved that is no greater than 50 kN/mm while maintaining the stability requirements over the service life.

It is also advantageous for a fastening element to be provided, which is insertable into the base body in the area of the opening, and for the first annular element to interact with the base body via the fastening element. In this instance, it is furthermore advantageous for the fastening element to be developed as a plate-shaped fastening element and for the plate-shaped fastening element to be insertable into the base body in such a way that the opening of the base body is partially closed, a clearance being made possible between the fuel fitting and the plate-shaped fastening element in the installed state. This allows on the one hand for a simple installation. In the installation process, the fuel fitting of the fuel injector is inserted into the receiving space of the base body. This occurs in such a way that the first annular element and the second annular element are subsequently situated in their specified positions. The plate-shaped fastening element may then be snapped into place in the base body for example, the plate-shaped fastening element not only securing the first annular element, but also forming a contact surface for the first annular element. If in operation fuel is supplied at the inflow location between the first annular element and the second annular element, then the first annular element is pressed against the plate-shaped fastening element. For this purpose, the fastening element preferably has an axial supporting surface for the first annular element, which faces the inner receiving space of the base body, the first annular element being axially supported on the axial supporting surface of the fastening element.

It is also advantageous for the base body to have an axial inflow opening, for at least one fuel channel to be developed in the base body and for the fuel channel to convey a fuel at least in part radially inward to the inflow location. In this connection, it is furthermore advantageous for the fuel channel to channel the fuel radially outside past the second annular element. This makes it possible in particular to implement an essentially pot-shaped or cup-shaped development of the connecting element. A use in existing designs is possible without a constructional modification effort or with only a little constructional modification effort.

It is moreover advantageous for an axial supporting surface of the base body to be developed in the receiving space for the second annular element, which faces the opening of the base body, and for the second annular element to be axially supported on the axial supporting surface of the base body. This allows for a reliable positioning of the second annular element already during installation. It is furthermore advantageous for the first annular element to ensure sealing of the inflow location with respect to an area that has lower pressure in operation via a first diameter and for the second annular element to ensure sealing of the inflow location with respect to an area that has lower pressure in operation via a second diameter. This allows for a connection of the fuel injector to the fuel-carrying component that is more pressure-balanced or is pressure-balanced and thus is more force-balanced or is force-balanced. For this purpose, the first diameter and the second diameter may be chosen to be of equal size so as to result in a constructionally simple design.

It is also advantageous, however, for the first diameter to be greater than the second diameter. An axially acting hydraulic force may thereby be produced, which depends on the pressure at the inflow location. This axial force then acts in the direction of a nozzle-proximate end of the fuel injector such that, depending on the design, this force may act as an additional or the sole retaining force.

It is advantageous in particular for the first diameter and the second diameter to be specified in such a way that relative to a specified system pressure a specified axial hydraulic retaining force may be produced that acts in the installed state and in operation on the fuel injector due to the system pressure. As a result, an additional holding-down clamp, which acts via a spring force, or the like may be eliminated.

DETAILED DESCRIPTION

Figure 1:
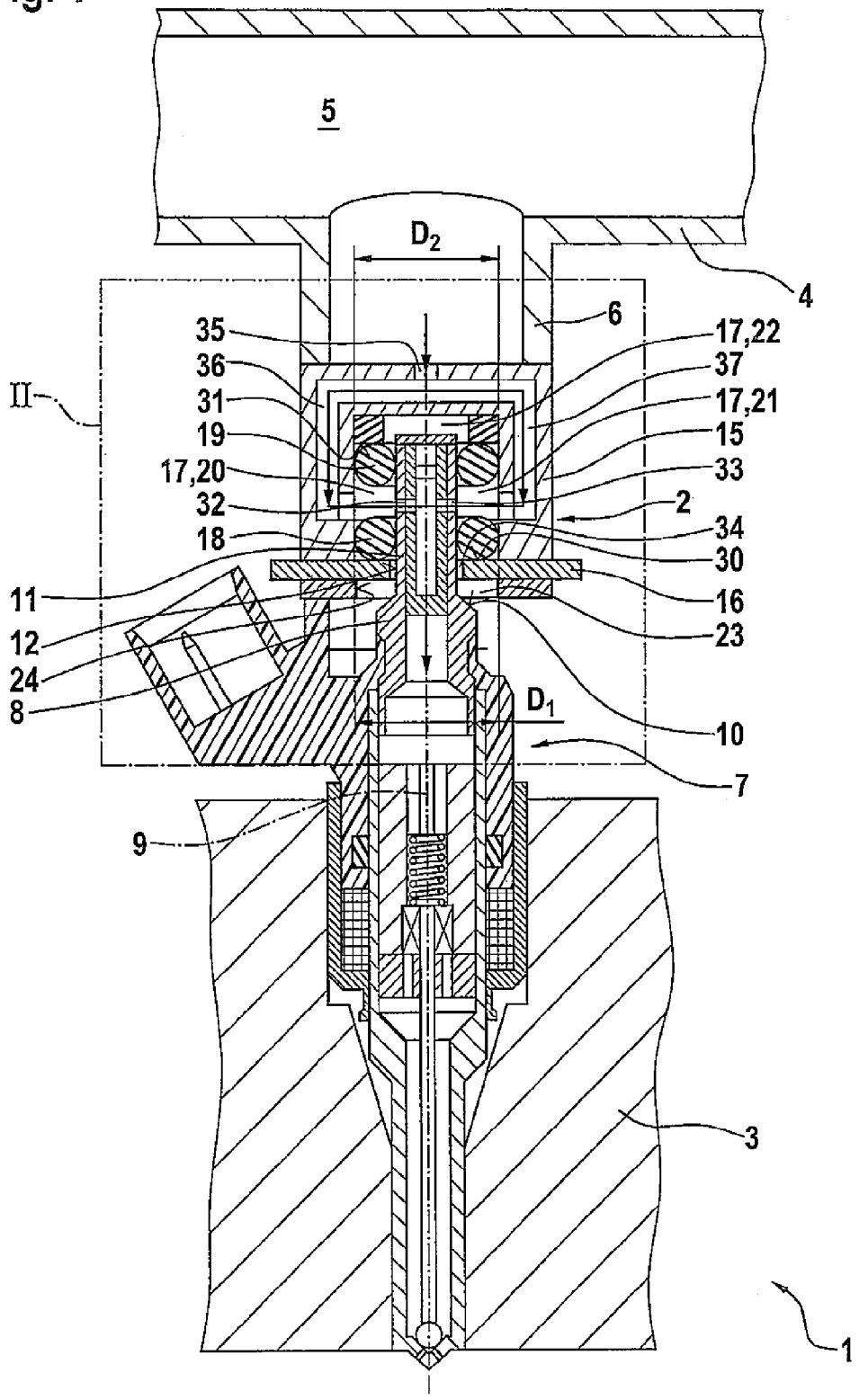
FIG. 1 shows a fuel injection system having a connecting element corresponding to a first exemplary embodiment of the present invention and an internal combustion engine in an excerpted, schematic sectional view.

FIG. 1 shows a fuel injection system 1 having a connecting element 2 corresponding to a first exemplary embodiment of the present invention and an internal combustion engine 3 in an excerpted, schematic sectional view. Fuel injection system 1 may be particularly used for high-pressure injection in internal combustion engines 3. In particular, fuel injection system 1 may be used in mixture-compressing internal combustion engines 3 having externally supplied ignition. Connecting element 2 is particularly suitable for such a fuel injection system 1.

Fuel injection system 1 has a fuel-carrying component 4. In this exemplary embodiment, component 4 is developed as fuel distributor 4, in particular as fuel distributor rail 4. Fuel distributor 4 has a fuel chamber 5, into which highly pressurized fuel is conveyed by a high-pressure pump (not shown). Fuel distributor 4 has multiple outlets 6, of which only outlet 6 is shown in FIG. 1 for the sake of simplifying the representation.

Fuel injection system 1 additionally has a fuel injector 7, which is connected to outlet 6 of fuel distributor 4 via connecting element 2. For this purpose, connecting element 2 may be suitably connected to outlet 6, which is shown only schematically in FIG. 1.

Fuel injector 7 has an axis 9. In this exemplary embodiment, fuel fitting 8 extends along axis 9. An axis of connecting element 2 matches axis 9 in this exemplary embodiment.

In this exemplary embodiment, fuel fitting 8 of fuel injector 7 has a conical shoulder 10, to which a tubular connecting piece 11 having a cylinder sleeve-shaped outside is connected.

Connecting element 2 has a base body 15, which may be developed as one part or multiple parts. Connecting element 2 furthermore has a plate-shaped fastening element 16. A receiving space 17 is developed in base body 15, into which tubular connecting piece 11 of fuel fitting 8 is inserted. Receiving space 17 furthermore accommodates a first annular element 18 and a second annular element 19 of connecting element 2. In the installed state shown in FIG. 1, annular elements 18, 19 on the one hand interact with fuel fitting 8 inserted into receiving space 17 and, on the other hand, with base body 15.

First annular element 18 is developed as O-shaped sealing ring 18. Second annular element 19 is furthermore developed as O-shaped sealing ring 19. Annular elements 18, 19 abut against cylinder sleeve-shaped outside 12 of tubular connecting piece 11. A seal is achieved in the process on the one hand with respect to tubular connecting piece 11 and on the other hand with respect to base body 15. Annular elements 18, 19 are moreover situated at a distance from each other with respect to axis 9. Inflow locations 20, 21 are thereby formed in receiving space 17 between annular elements 18, 19. Inflow locations 20, 21 are thus situated axially between first annular element 18 and second annular element 19. Inflow locations 20, 21 are sealed on the one hand with respect to an area 22 of receiving space 17. Furthermore, inflow locations 20, 21 are sealed with respect to an area 23, which in this exemplary embodiment lies in the surroundings of connecting element 2 or borders on the latter. In this exemplary embodiment, area 23 lies at least partially in an opening 24 of base body 15, via which tubular connecting piece 11 of fuel fitting 8 is insertable into receiving space 17 during installation. In the installed state, tubular connecting piece 11 extends through opening 24 of base body 15.

Plate-shaped fastening element 16 is inserted into base body 15 in the area of opening 24 of base body 15. Plate-shaped fastening element 16 may in this instance be engaged into base body 15. In a modified development, fastening element 16 may also be developed as a fastening bracket or mounting clip.

First annular element 18 is axially supported on an axial supporting surface 30 of plate-shaped fastening element 16. First annular element 18 as a result interacts with base body 15 via fastening element 16. In operation, the flux of force starts out from fuel fitting 8 of fuel injector 7, proceeds via first annular element 18 to fastening element 16 and then to base body 15.

Receiving space 17 additionally includes an axial supporting surface 31 of base body 15 for second annular element 19. Axial supporting surface 31 faces axial supporting surface 30 of fastening element 16. Axial supporting surface 30 of base body 15 furthermore faces opening 24 of base body 15, while axial supporting surface 30 of fastening element 16 faces inner receiving space 17 of base body 15.

By the support of second annular element 19 on axial supporting surface 31, area 22 is sealed with respect to inflow locations 20, 21 of receiving space 17. In operation, area 22 of receiving space 17 therefore remains pressure-free or at least at a lower pressure than a system pressure $p_s$. Furthermore, area 23 is pressure-free since it lies in the surrounding area.

The flow guidance within base body 15 is predefined in such a way that the fuel flowing in from fuel chamber 5 enters into tubular connecting piece 11 via inflow locations 20, 21. For this purpose, tubular connecting piece 11 has inflow bores 32, 33, which extend in the radial direction with respect to axis 9. Since inflow bores 32, 33 lie across from each other with respect to axis 9, a support of fuel injector 7 is possible that is free of transverse force.

In operation, fuel thus flows from inflow locations 20, 21 of receiving space 17 via inflow bores 32, 33 into tubular connecting piece 11.

First annular element 18 ensures a seal of inflow locations 20, 21 with respect to area 23 at a pressure that is lower in operation via a first diameter $D_1$. Via a second diameter $D_2$, the second annular element 19 ensures sealing of inflow locations 20, 21 with respect to area 22, which has a lower pressure in operation. In this exemplary embodiment, first diameter $D_1$ is equal to second diameter $D_2$. The attachment of fuel injector 7 via connecting element 2 is thus pressure-balanced and therefore balanced in terms of axial force. In this exemplary embodiment, a support is achieved that is both free of axial force as well as free of transverse force.

In this exemplary embodiment, fastening element 16 is inserted into base body 15 in such a way that opening 24 of base body 15 is partially closed and a clearance 34 remains between fuel fitting 8 and plate-shaped fastening element 16. Thus tubular connecting piece 11 makes no contact anywhere with fastening element 16.

Base body 15 has an axial inflow opening 35, via which fuel flows from fuel chamber 5 of fuel distributor 4 into fuel channels 36, 37 developed within base body 15. For this purpose, fuel channels 36, 37 initially channel the fuel radially outward and then radially outside of receiving space 17 past second annular element 19. At the level of inflow locations 20, 21, fuel channels 36, 37 channel the fuel again in the radial direction back to axis 9. Fuel channels 36, 37 thus channel the fuel radially outside past second annular element 18. Fuel channels 36, 37 furthermore channel the fuel radially inward to inflow locations 20, 21 in receiving space 17.

It is thus possible to connect fuel injector 7 in a pressure-balanced manner to fuel distributor 4 in order to prevent or at least minimize axial forces on fuel injector 7 by the system pressure $p_s$. By contrast, in an axial filling of a fuel injector, high loads may act on a conventional fuel injector due to the diameter of the rail cup and the active system pressure $p_s$, which loads may lie in a range of several kN for example. This is avoided by the design according to the exemplary development. Specifically, the lateral symmetrically structured inflow to fuel injector 7 allows for the pressure-balanced support of fuel injector 7 such that the load from system pressure $p_s$ is compensated. In the process, it is possible to achieve simultaneously a pressure balance and a soft connection such that the respective advantages are combined.

The advantage of a soft suspension is a clear reduction of the transmitted structure-borne noise from fuel injector 7 to fuel distributor 4. This is also associated with a reduction of the noise of fuel injection system 1. Moreover, this measure is effective in addition to further noise-reducing measures. This measure may thus be used in combination with additional measures, particularly a hydraulic throttle in the inlet area and a soft screw attachment of the rail.

One advantage of the pressure balance is also a marked reduction of the stability requirements of the connection between fuel injector 7 and fuel distributor 4.

It is thus possible to achieve a pressure balance in a suspended fuel injector. In a modified development, however, a pressure balance is correspondingly possible even in the case of a plugged fuel injector 7 that rests on internal combustion engine 3, in particular a cylinder head of internal combustion engine 3, where the transmission may occur via a tolerance equalization element or decoupling element. In such a design, the axial force is also significant for the design of the decoupling element such that even in the case of a plugged fuel injector 7 substantial advantages exist because of the combination of pressure balance and decoupling from internal combustion engine 3, since in particular the stability requirements of a tolerance equalization element or a decoupling element are markedly reduced.

Connecting element 2 may thus be used advantageously in a plurality of possible developments of fuel injector 7.

It should be noted that a possible fuel flow in operation is illustrated by arrows.

Figure 2:
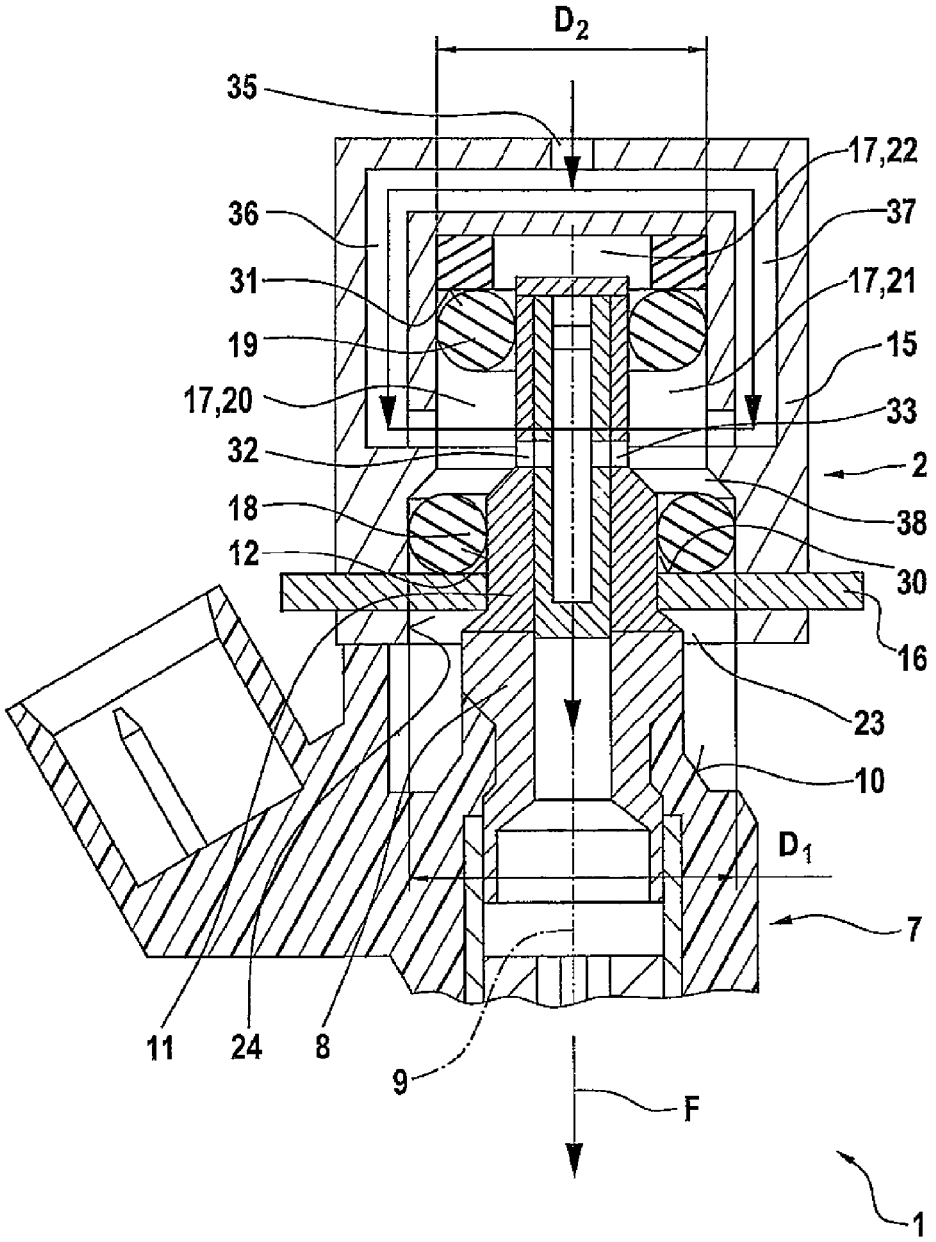
FIG. 2 shows the section of the fuel injection system indicated by II in FIG. 1 according to a second exemplary embodiment of the present invention.

FIG. 2 shows the section of fuel injection system 1 indicated by II in FIG. 1 having connecting element 2 in accordance with a second exemplary embodiment of the present invention in an excerpted schematic sectional view. In this exemplary embodiment, first diameter $D_1$ is specified to be greater than second diameter $D_2$.

In this exemplary embodiment, base body 15 has a radial extension 38. Furthermore, first annular element 18 is developed to have a greater diameter than second annular element 19.

In operation, first annular element 18 ensures a sealing of inflow locations 20, 21 with respect to pressure-free area 23 via first hydraulic diameter $D_1$. On the other hand, second annular element 19 ensures a sealing of inflow locations 20, 21 with respect to area 22 of receiving space 17 via second hydraulic diameter $D_2$. Area 22 of receiving space 17 as a result remains as free of pressure as possible or at least at a substantially lower pressure than system pressure $P_s$ at inflow locations 20, 21. If necessary, a pressure relief of area 22 of receiving space 17 is also possible via a relief bore or the like.

The differently dimensioned hydraulic diameters $D_1$, $D_2$ result in an axially acting hydraulic force F as a function of system pressure $p_s$. Since diameter $D_2$ is chosen to be greater than diameter $D_1$, this force F acts upon fuel injector 7 in the direction of internal combustion engine 3. Under ideal conditions, force F is calculated according to the appended formula (1).

In accordance with the formula (1), first diameter $D_1$ and second diameter $D_2$ may thus be specified in such a way that in relation to the specified system pressure $p_s$, a specified axial hydraulic retaining force is able to be generated, which in operation acts on fuel injector 7. In particular, formula (1) is as follows: (1) $F=\pi/4((D_2)\hat{}2+((D_1)\hat{}2)\cdot p_s$. A separate holding-down element, a spring clip or the like may thus be eliminated or at least may be designed to be substantially weaker.

In a modified development, a retaining force F may be specified even in the case of a plugged fuel injector 7. For this purpose, the two annular elements 18, 19 may be fastened on fuel injector 7 via corresponding receptacles. The hydraulic force F is then specifiable via the diameters of the annular elements 18, 19.

The present invention is not limited to the exemplary embodiments described.

What is claimed is:

1. A connecting element for a fuel injection system for connecting a fuel injector to a fuel-carrying component, comprising:

a base body having a receiving space and an opening, via which a fuel fitting of the fuel injector is at least partially insertable into the receiving space of the base body;

a first annular element provided in the receiving space of the base body, wherein in the installed state the first annular element interacts with the fuel fitting inserted into the receiving space and with the base body; and a second annular element provided in the receiving space of the base body, wherein:

the first annular element and the second annular element in the installed state abut against an outside of the fuel fitting, and the first annular element and the second annular element are situated axially at a distance from each other and seal at least one inflow location situated axially between the first annular element and the second annular element.

2. The connecting element as recited in claim 1, wherein at least one of the first annular element and the second annular element includes an O-shaped sealing ring.

3. The connecting element as recited in claim 1, further comprising:

a fastening element insertable into the base body in an area of the opening, wherein the first annular element interacts with the base body via the fastening element.

4. The connecting element as recited in claim 3, wherein the fastening element includes a plate-shaped fastening element inserted into the base body in such a way that the opening of the base body is partially closed, a clearance being made possible between the fuel fitting and the plate-shaped fastening element in the installed state.

5. The connecting element as recited in claim 3, wherein the fastening element has an axial supporting surface for the first annular element, the axial supporting surface facing the receiving space of the base body, and the first annular element being axially supported on the axial supporting surface of the fastening element.

6. The connecting element as recited in claim 1, wherein:

the base body has an axial inflow opening, at least one fuel channel is developed in the base body, and the fuel channel conveys a fuel at least in part radially inward to the inflow location.

7. The connecting element as recited in claim 6, wherein the fuel channel channels the fuel radially outside past the second annular element.

8. The connecting element as recited in claim 1, wherein:

an axial supporting surface of the base body is developed in the receiving space for the second annular element, which faces the opening of the base body, and the second annular element is axially supported on the axial supporting surface of the base body.

9. The connecting element as recited in claim 1, wherein:

the first annular element ensures a sealing of the inflow location with respect to a first area that has a lower pressure in operation via a first diameter, the second annular element ensures a sealing of the inflow location with respect to a second area that has a lower pressure in operation via a second diameter, and the first diameter is greater than the second diameter.

10. The connecting element as recited in claim 9, wherein:

the first diameter and the second diameter are predefined in such a way that in relation to a predefined system pressure a predefined axial hydraulic retaining force is able to be generated, which in the installed state acts on the fuel injector due to the system pressure.

11. A fuel injection system, comprising:

at least one fuel-carrying component;

at least one fuel injector; and at least one connecting device via which the fuel injector is connected to the fuel-carrying component, the connecting device including:

a base body having a receiving space and an opening, via which a fuel fitting of the fuel injector is at least partially insertable into the receiving space of the base body;

a first annular element provided in the receiving space of the base body, wherein in the installed state the first annular element interacts with the fuel fitting inserted into the receiving space and with the base body; and a second annular element provided in the receiving space of the base body, wherein:

the first annular element and the second annular element in the installed state abut against an outside of the fuel fitting, and the first annular element and the second annular element are situated axially at a distance from each other and seal at least one inflow location situated axially between the first annular element and the second annular element.

12. The fuel injection system as recited in claim 11, wherein the fuel injection system is for a mixture-compressing internal combustion engine having an externally supplied ignition.

* * * * *